US011011289B2

(12) United States Patent
Bachmaier

(10) Patent No.: US 11,011,289 B2
(45) Date of Patent: May 18, 2021

(54) ANTI-KINK DEVICE FOR A CABLE

(71) Applicant: LEONI KABEL GMBH, Roth (DE)

(72) Inventor: Walter Bachmaier, Friesoythe (DE)

(73) Assignee: LEONI KABEL GMBH, Nuremberg (DE)

( * ) Notice: Subject to any disclaimer, the term of this patent is extended or adjusted under 35 U.S.C. 154(b) by 0 days.

(21) Appl. No.: 16/243,537

(22) Filed: Jan. 9, 2019

(65) Prior Publication Data

US 2019/0221337 A1 Jul. 18, 2019

(30) Foreign Application Priority Data

Jan. 15, 2018 (DE) ..... 102018200550.8

(51) Int. Cl.

| | |
|---|---|
| ***H01B 17/58*** | (2006.01) |
| ***H01R 13/59*** | (2006.01) |
| ***H01R 13/56*** | (2006.01) |
| ***H01B 17/26*** | (2006.01) |

(52) U.S. Cl.

CPC ..... *H01B 17/583* (2013.01); *H01B 17/26* (2013.01); *H01R 13/562* (2013.01); *H01R 13/59* (2013.01); *H01R 13/56* (2013.01); *H01R 13/565* (2013.01)

(58) Field of Classification Search

CPC ..... H01B 17/26; H01B 17/583; H01R 13/56; H01R 13/562; H01R 13/565; H01R 13/59

See application file for complete search history.

(56) References Cited

U.S. PATENT DOCUMENTS 2,399,221 A * 4/1946 Freas ..... B64D 1/14 244/138 R
2,420,826 A * 5/1947 Irrgang ..... H02G 3/065 174/153 G
2,424,756 A * 7/1947 Klumpp, Jr. ..... H02G 3/083 174/153 G
2,424,758 A * 7/1947 Klumpp, Jr. ..... F16L 5/00 174/153 G (Continued)

FOREIGN PATENT DOCUMENTS

CN 1779290 A 5/2006
CN 102047517 A 5/2011

(Continued)

*Primary Examiner* — William H. Mayo, III
*Assistant Examiner* — Rhadames Alonzo Miller
(74) *Attorney, Agent, or Firm* — Tarolii, Sundheim, Covell & Tummino LLP

(57) ABSTRACT

An anti-kink device for a cable is provided. The anti-kink device for a cable comprises:

an anti-kink bush which can be secured on a cable, wherein the anti-kink bush has at least one first snap-in element, a first connecting element which has an opening for the passage of the anti-kink bush, wherein the first connecting element has at least one second snap-in element, a second connecting element which can be connected to the first connecting element, wherein the at least one first snap-in element and the at least one second snap-in element are in such a form that, in a first position of the anti-kink bush relative to the first connecting element, they allow the anti-kink bush to be guided through the opening of the first connecting element and, in a second position of the anti-kink bush relative to the first connecting element, they can be locked together.

7 Claims, 8 Drawing Sheets

(56) References Cited

U.S. PATENT DOCUMENTS 2,424,759 A * 7/1947 Klumpp, Jr. ..... H02G 3/0675 174/153 G
2,724,736 A * 11/1955 Klumpp, Jr. ..... H01B 17/58 174/153 G
2,930,840 A * 3/1960 Klumpp, Jr. ..... H02G 3/0633 174/153 R
2,974,186 A * 3/1961 Klumpp, Jr. ..... H01R 13/5816 174/153 G
3,953,665 A * 4/1976 Nicholson ..... F16L 5/00 174/153 G
4,056,252 A * 11/1977 Simon ..... H02G 3/0683 248/56
4,215,505 A * 8/1980 Henze ..... A01K 91/08 43/27.4
4,340,772 A * 7/1982 Bose ..... H02G 3/16 174/51
4,492,816 A * 1/1985 Morel ..... H02G 15/113 174/77 R
4,693,550 A * 9/1987 Brown ..... G02B 6/381 385/81
4,824,198 A * 4/1989 Anderton ..... G02B 6/2553 385/135
4,889,406 A * 12/1989 Sezerman ..... G02B 6/32 385/35
5,080,460 A * 1/1992 Erdman ..... G02B 6/3887 385/81
5,531,489 A * 7/1996 Cetnar ..... E05B 85/12 292/225
5,611,012 A * 3/1997 Kuchenbecker ..... G02B 6/3889 385/139
5,749,756 A * 5/1998 Vockroth ..... H01R 4/203 174/84 C
6,151,432 A * 11/2000 Nakajima ..... G02B 6/3831 385/55
6,238,104 B1 * 5/2001 Yamakawa ..... G02B 6/3869 385/81
6,382,844 B1 * 5/2002 Dubois ..... G02B 6/3861 385/81
6,520,796 B1 * 2/2003 Reichle ..... H01R 13/465 439/491
6,623,181 B1 * 9/2003 Daems ..... G02B 6/2558 385/99
7,040,491 B1 * 5/2006 Claprood ..... H05K 7/1425 211/183
2002/0159711 A1 * 10/2002 Lutzen ..... G02B 6/3838 385/62
2002/0164130 A1 * 11/2002 Elkins, II ..... G02B 6/3887 385/87
2005/0199609 A1 * 9/2005 Wanner ..... H05B 3/06 219/528
2006/0169473 A1 * 8/2006 Dobler ..... H01R 13/562 174/73.1
2007/0297744 A1 * 12/2007 Martin ..... G02B 6/2558 385/135
2009/0087147 A1 * 4/2009 Barnes ..... G02B 6/3887 385/72
2013/0334919 A1 * 12/2013 Welp ..... H02K 7/06 310/80
2015/0083455 A1 * 3/2015 Keith ..... H01R 13/5816 174/73.1
2015/0131945 A1 * 5/2015 Scopic ..... G02B 6/3887 385/87

FOREIGN PATENT DOCUMENTS

CN 103250304 A 8/2013
CN 104169620 A 11/2014
DE 29914189 U1 11/1999
DE 10135971 C1 4/2003
DE 20204382 U1 9/2003

* cited by examiner

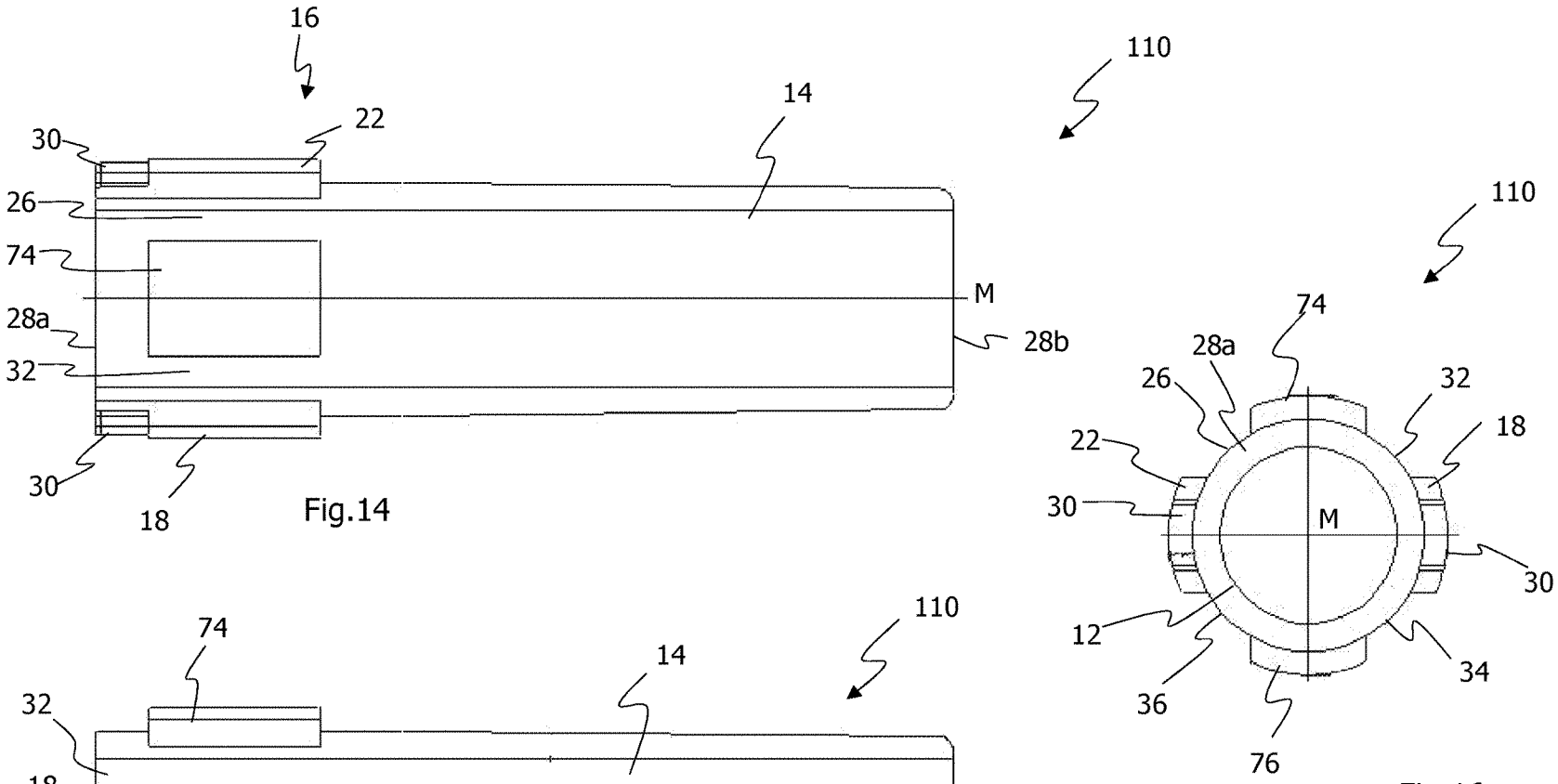
Fig.14
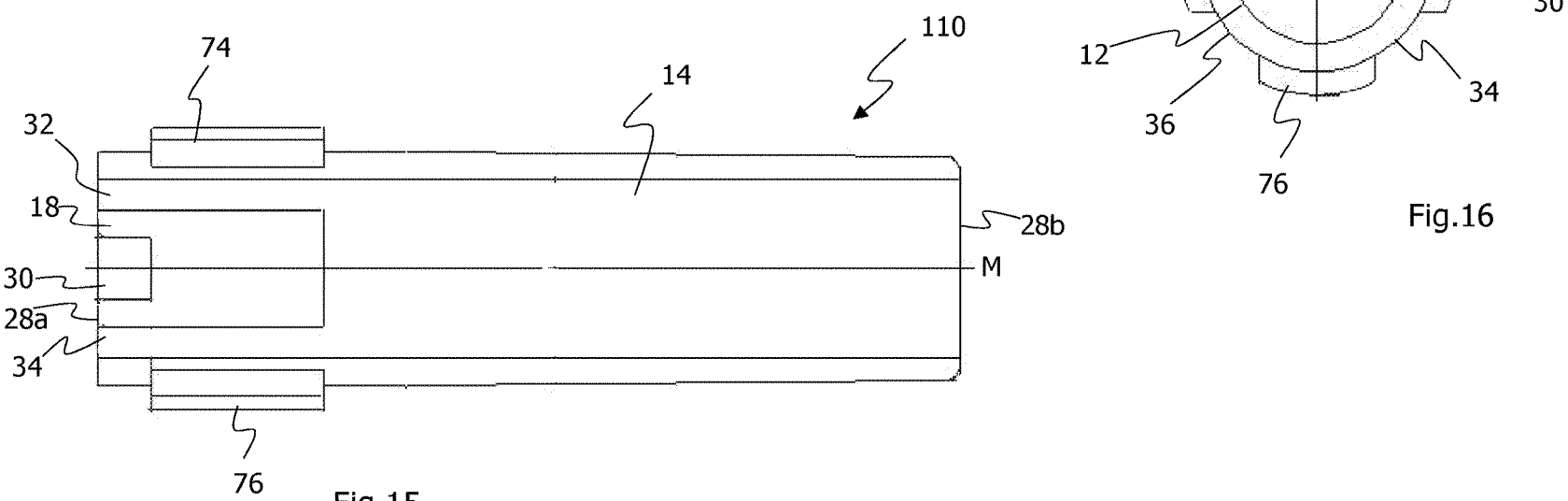
Fig.15
Fig.16

ANTI-KINK DEVICE FOR A CABLE

RELATED APPLICATION

The present invention claims priority of DE 10 2018 200 550.8, filed on 15 Jan. 2018, the entirety of which is incorporated herein by reference.

TECHNICAL FIELD

The present invention relates to an anti-kink device for a cable. The present invention relates further to a method of fitting such an anti-kink device for a cable.

BACKGROUND ART

An anti-kink device for cables is intended to prevent cables from bending or kinking when they are connected to a housing part, which can result in the cables being damaged. Such a housing part can be, for example, a connector housing or a plug housing. An anti-kink device for a cable has an anti-kink bush which is connected to the cable. The anti-kink bush is intended to protect the cable in the region of the lead-through opening of the housing part and to that end is able to absorb the forces that occur when the cable bends or moves. In this manner, damage to the cable can be prevented. Such an anti-kink device for a cable is known, for example, from document DE 101 35 971 C1.

DISCLOSURE OF THE INVENTION

There is a need for an anti-kink device for cables which has a simplified construction and can easily be fitted and removed.

Such a need is met by the subject matter of the claims.

According to one aspect, an anti-kink device for a cable is provided. The anti-kink device for a cable comprises:

an anti-kink bush which can be secured on a cable, wherein the anti-kink bush has at least one first snap-in element, a first connecting element which has an opening for the passage of the anti-kink bush, wherein the first connecting element has at least one second snap-in element, a second connecting element which can be connected to the first connecting element, wherein the at least one first snap-in element and the at least one second snap-in element are configured such that (are in such a form that), in a first position of the anti-kink bush relative to the first connecting element, they allow the anti-kink bush to move through the opening of the first connecting element and, in a second position of the anti-kink bush relative to the first connecting element, they can be locked together.

In the second position, the at least one first snap-in element and the at least one second snap-in element can block a movement of the anti-kink bush through the opening of the first connecting element. This state can be fixed by connecting the first connecting element to the second connecting element.

The anti-kink bush and the first connecting element, and thus also the at least one first snap-in element and the at least one second snap-in element, can be transferred out of the first position into the second position by a relative movement between the anti-kink bush and the first connecting element. The same can apply to the transfer out of the second position back into the first position.

The relative movement for transferring the anti-kink bush and/or the first connecting element from the first position into the second position and back can be a rotational movement of the anti-kink bush relative to the first connecting element. Alternatively, the relative movement can also be a rotational movement of the first connecting element relative to the anti-kink bush. The rotational movement or the relative rotation between the anti-kink bush and the first connecting element can be carried out through a predetermined angle in order to move the anti-kink bush and/or the second connecting element between the first position and the second position. The angle can be between 20° and 70°. For example, the angle of the relative rotation can be 45°.

The at least one first snap-in element and the at least one second snap-in element can be configured such that (can be in such a form that), in the second position, they establish an interlocking connection acting in the peripheral direction of the anti-kink bush and/or of the first connecting element. As a result of the interlocking connection, the at least one first snap-in element and the at least one second snap-in element can form an anti-rotation device which prevents rotation between the anti-kink bush and the first connecting element.

The anti-kink bush can have guide projections. The guide projections can extend outwards in the radial direction. In other words, the guide projections can protrude in the radial direction from the outer peripheral surface of the anti-kink bush. The guide projections can extend in the axial direction along the outer peripheral surface of the anti-kink bush. The guide projections can extend over a predetermined portion of the axial extent of the anti-kink bush. In particular, the guide projections can be arranged at an end portion of the anti-kink bush. For example, the guide projections can extend starting from one end of the anti-kink bush in the direction of the other end of the anti-kink bush. The guide projections can be spaced apart from one another and offset relative to one another. The guide projections can be provided on the anti-kink bush offset relative to one another by a predetermined angle. For example, the guide projections can be arranged on the anti-kink bush offset relative to one another by 90°. Four guide projections, for example, can be provided on the anti-kink bush.

The guide projections can form between them at least one guideway for the at least one second snap-in element of the first connecting element. The guide projections can define the at least one guideway between them in the peripheral direction of the anti-kink bush. The guideway can extend in the axial direction between adjacent guide projections. In the first position, the at least one second snap-in element can be received in part in the at least one guideway. The at least one guideway can cooperate with the at least one second snap-in element in order to guide the movement of the anti-kink bush through the opening in the first connecting element in the first position at least in part. By means of the cooperation of the guide projections, or the guideways, with the at least one second snap-in element, the anti-kink bush and the at least one connecting element can be centered on one another.

At least some of the guide projections of the anti-kink bush can each have at least one first snap-in element. In other words, some of the guide projections can have a first snap-in element while other guide projections do not have a first snap-in element. The guide projections with a first snap-in element and the guide projections without a first snap-in element can be arranged alternately. For example, the guide projections with and without a first snap-in element can be arranged alternately in the peripheral direction of the anti-kink bush. The guide projections with and without a first snap-in element can be offset relative to one another. This offset can be 90°, for example. In this case, the guide projections with a first snap-in element can be offset by 180° relative to one another. The same applies to the guide projections without a first snap-in element. Alternatively, all the guide projections of the anti-kink bush can each have at least one first snap-in element.

The guide projections can be made from the same material as the anti-kink bush. The guide projections can be molded onto the anti-kink bush. The guide projections can be formed integrally with the anti-kink bush. The anti-kink bush can be produced together with the guide projections, for example by an injection molding process.

The at least one second snap-in element can be arranged in an axial end region of the opening of the first connecting element. The at least one second snap-in element can be formed integrally with the first connecting element. The at least one second snap-in element can reduce the inside diameter of the opening of the first connecting element at least in part.

The at least one first connecting element can have a plurality of second snap-in elements. The second snap-in elements can be arranged in the opening of the first connecting element spaced apart from one another and offset in the peripheral direction relative to one another. The second snap-in elements can extend radially inwards starting from the inner peripheral surface of the opening. The second snap-in elements can reduce the inside diameter of the opening in part. The inside diameter of the opening can be reduced by mutually opposite second snap-in elements in such a manner that the inside diameter in the region of the second snap-in elements is smaller than the outside diameter of the anti-kink bush in the region of the guide projections.

The at least one first snap-in element can be a snap-in recess. The snap-in recess can receive the at least one second snap-in element at least in part. The snap-in recess can form a stop for the at least one second snap-in element. The snap-in recess can be open radially outwards and in the direction of one end of the anti-kink bush, that is to say in the axial direction. The at least one second snap-in element can thereby be introduced into the snap-in recess.

The at least one second snap-in element can be a snap-in projection. The snap-in projection can protrude radially inwards. The snap-in projection can protrude radially inwards starting from the inner peripheral surface of the opening in the first connecting element. The snap-in projection can extend over a predetermined portion of the inner peripheral surface of the opening. The snap-in projection can have a curved surface which forms the radially inner end of the snap-in projection. The curvature of this surface can be matched to the radius of the anti-kink bush in the region of the at least one guideway.

According to a further aspect there is provided a method of fitting an anti-kink device for a cable. The method comprises the following steps:

displacing the anti-kink bush and/or the first connecting element into the first position, in which the at least one first snap-in element and the at least one second snap-in element allow the anti-kink bush to move through the opening of the first connecting element;

moving the anti-kink bush and the cable connected thereto through the opening of the first connecting element, wherein/whereby the anti-kink bush and the first connecting element are in the first position;

withdrawing the anti-kink bush and the cable in the first position through the opening in the first connecting element, wherein/whereby the anti-kink bush and the first connecting element are in the first position;

displacing the anti-kink bush and/or the first connecting element into the second position, in which the at least one first snap-in element and the at least one second snap-in element can be locked together;

locking the at least one first snap-in element and the at least one second snap-in element together; and connecting the first connecting element and the second connecting element.

Once the first snap-in element and the second snap-in element have been displaced into the second position, the first snap-in element and the second snap-in element can be locked together by an axial movement between the anti-kink bush and the first connecting element. Displacement out of the first position into the second position and back can take place, for example, by a relative rotation between the anti-kink bush and the first connecting element through a predetermined angle. The angle through which, for example, the anti-kink bush is displaced relative to the first connecting element can be between 20° and 70°. For example, the angle can be 45°.

Before the anti-kink bush is withdrawn, a step for terminating the end of the cable and/or for attaching a connector can be carried out.

It will be appreciated that the terms used herein serve merely for describing individual embodiments and are not to be regarded limiting. Unless defined otherwise, all the technical and scientific terms used herein have the meaning which corresponds to the general understanding of the person skilled in the art in the relevant specialist field for the present disclosure; they are not to be interpreted either too broadly or too narrowly. If technical terms are used incorrectly herein and thus do not express the technical ideas of the present disclosure, they are to be replaced with technical terms which provide the person skilled in the art with a correct understanding. The general terms used herein are to be interpreted on the basis of the definition given in the dictionary or in accordance with the context; too narrow an interpretation is hereby to be avoided.

It is to be understood herein that terms such as, for example, "comprise" or "have", etc. mean the presence of the described features, numbers, actions, components, parts or combinations thereof and do not exclude the presence or the possible addition of one or more further features, numbers, actions, components, parts or combinations thereof.

Although terms such as "first" or "second" etc. may be used to describe different components, those components are not to be limited to those terms. The above terms are intended merely to distinguish one component from the others. For example, a first component may be referred to as a second component without departing from the scope of protection of the present disclosure; likewise, a second component may be referred to as a first component. The expression "and/or" includes both combinations of the plurality of mutually associated objects as well as each object of that plurality of the described plurality of objects.

If it is stated herein that a component "is connected to", "is associated with" or "acts on" another component, this may mean that it is directly connected thereto or acts directly thereon; however, it should be noted that there may be a further component between them. If, on the other hand, it is stated that a component "is directly connected to" or "acts directly on" another component, this is to be understood as meaning that no further components are present between them.

Specific embodiments of the present disclosure are described hereinbelow with reference to the accompanying drawings; in the drawings, components of the same type are always provided with the same reference numerals. In the description of the present disclosure, known associated functions or constructions are not explained in detail if this deviates unnecessarily from the meaning of the present disclosure; such functions and constructions are, however, understandable to the skilled person. The accompanying drawings of the present disclosure serve to illustrate the present disclosure and are not to be interpreted as being limiting. The technical idea of the present disclosure is to be interpreted as including, in addition to the accompanying drawings, also all such modifications, changes and variants.

BRIEF DESCRIPTION OF THE DRAWINGS

Further objectives, features, advantages and possible applications will become apparent from the following description of exemplary embodiments, which are not to be interpreted as being limiting, with reference to the accompanying drawings. In the drawings, all the features described and/or depicted show the subject matter disclosed herein on their own or in any desired combination, also independently of their grouping in the claims or their dependencies. The dimensions and proportions of the components shown in the drawings are not necessarily to scale; they may differ from that shown here in embodiments for implementation. In the drawings:

FIGS. 13 to 16 are views of an anti-kink bush according to a second embodiment.

DETAILED DESCRIPTION

Figure 1:
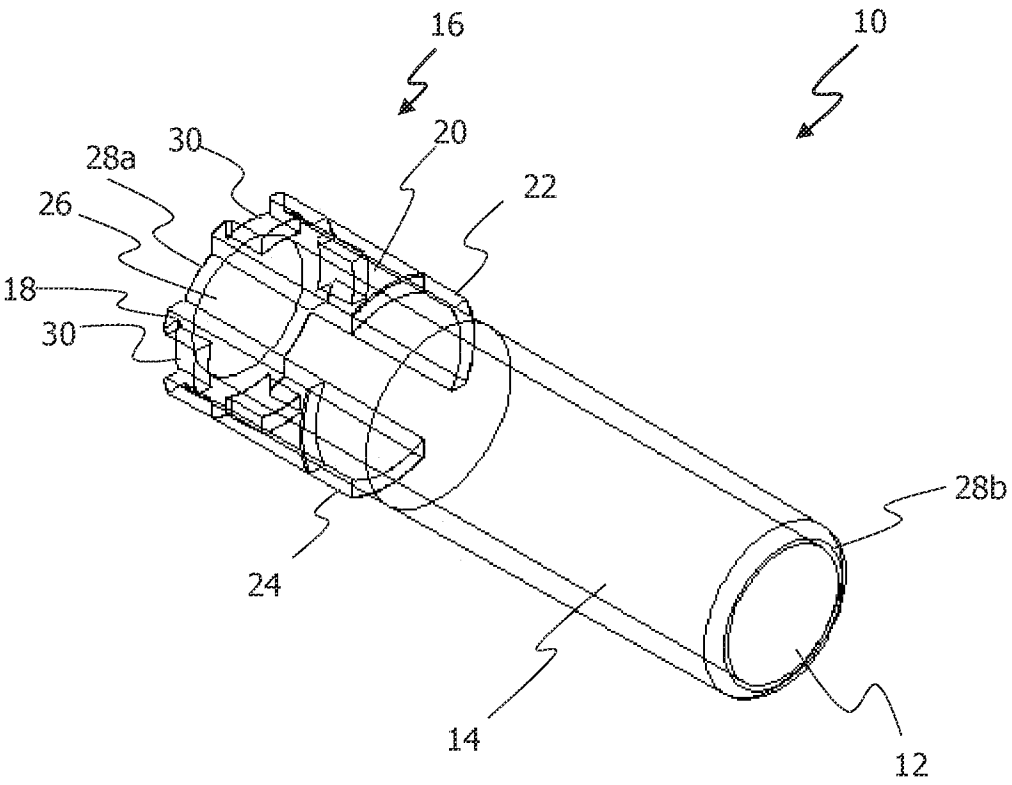
FIGS. 1 to 3 are views of an anti-kink bush according to a first embodiment.

FIG. 1 is a perspective view of an anti-kink bush 10. The anti-kink bush 10 has an opening 12 which extends through the entire anti-kink bush 10. The opening 12 serves for connecting the anti-kink bush 10 to a cable (not shown). The anti-kink bush 10 can be secured on a cable. The anti-kink bush 10 can, for example, be overmolded onto a cable by means of an injection molding process or otherwise fixedly connected to the cable.

The anti-kink bush 10 has a substantially tubular portion 14 and a connecting portion 16. The connecting portion 16 is shorter than the tubular portion 14. The anti-kink bush 10 has guide projections 18, 20, 22 and 24 in the connecting portion 16. The guide projections 18, 20, 22, 24 are formed integrally with the anti-kink bush 10. The guide projections 18, 20, 22, 24 extend outwards in the radial direction from the outer peripheral surface of the anti-kink bush 10. The guide projections 18, 20, 22 and 24 are formed on the outer peripheral surface of the anti-kink bush 10 offset relative to one another in the peripheral direction of the anti-kink bush 10. The guide projections 18, 20, 22, 24 form guideways between them, of which only the guideway 26 is visible in FIG. 1. The guideways extend in the peripheral direction of the anti-kink bush 10 between two adjacent guide projections 18, 20, 22, 24, The guideway 26 extends between the adjacent guide projections 18 and 20. The guide projections 18, 20, 22, 24 extend starting from one end 28*a* of the anti-kink bush 10 in the connecting portion 16 in the direction of the other end 28*b* of the anti-kink bush 10. The guide projections 18, 20, 22, 24 each have a snap-in recess 30 which extends starting from the end 28*a* of the anti-kink bush 10 into the guide projections 18, 20, 22, 24.

Figure 2:
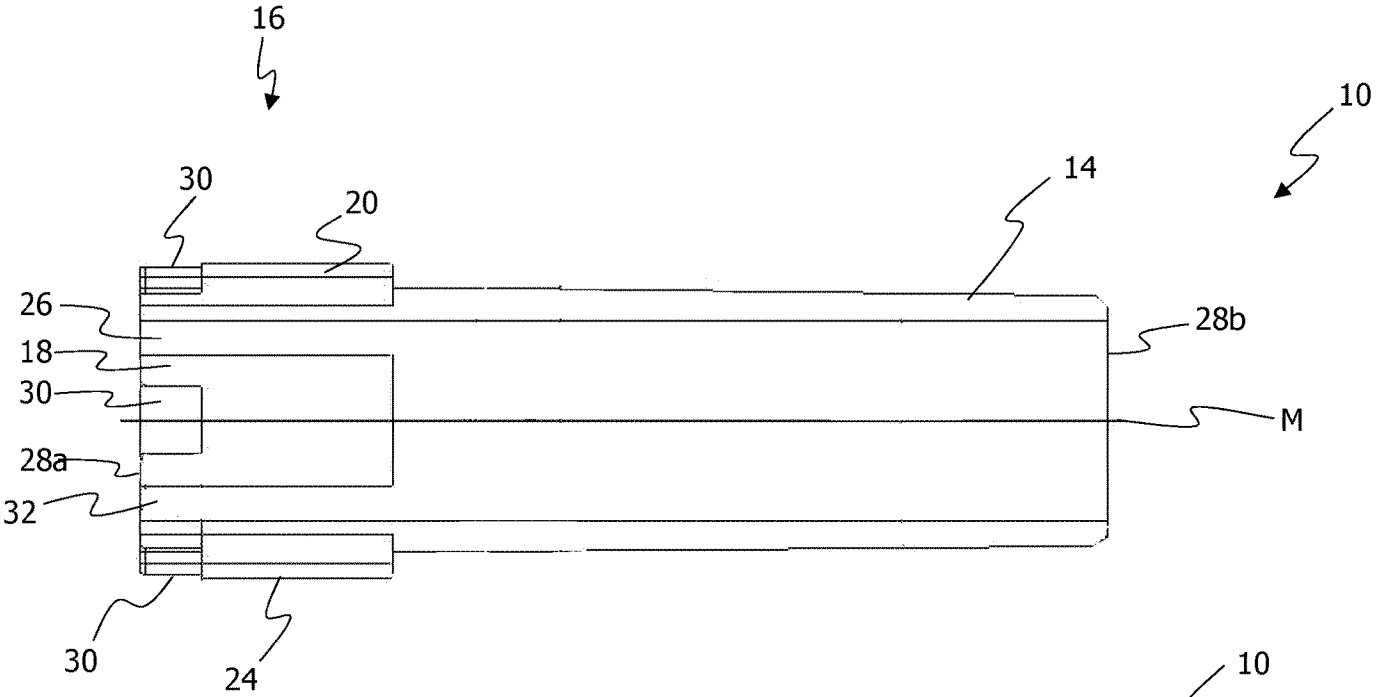

FIG. 2 is a side view of the anti-kink bush 10. The axis M of the anti-kink bush 10 is shown in FIG. 2. In FIG. 2, these guide projections 18, 20 and 24, each of which has a snap-in recess 30, are visible. The snap-in recess 30 extends starting from the end, or end face, 28*a* of the anti-kink bush 10 into the guide projections 18, 20, 24. The snap-in recess 30 is open in the direction of the end face 28*a* of the anti-kink bush 10. The guide projections 18, 20 and 24 define between them the guideways 26 and 32. The guideways 26 and 32 extend in the direction of the axis M along the guide projections 18, 20, 24. The extent of the connecting portion 16 in the direction of the axis M is substantially shorter than the extent of the tubular portion 14 in the direction of the longitudinal axis M. Starting from the end 28*a* of the anti-kink bush 10, the connecting portion 16 and thus also the guide projections 18, 20, 24 occupy a predetermined portion of the total extent of the anti-kink bush 10.

Figure 3:
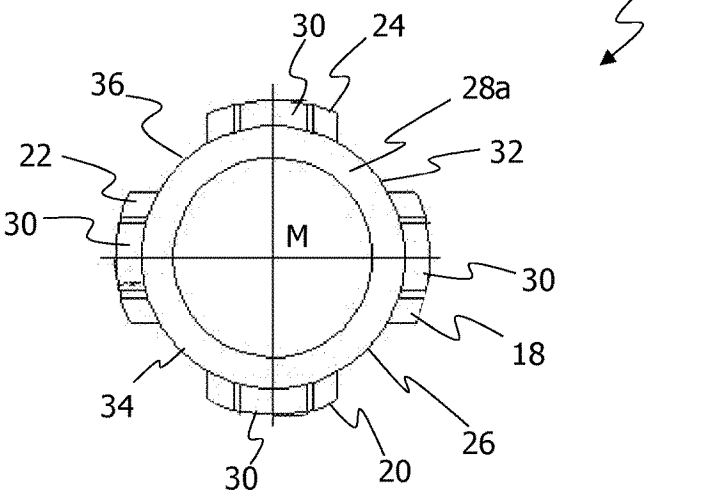

FIG. 3 shows a top view of the anti-kink bush 10. In FIG. 3, the anti-kink bush 10 is viewed from the end 28*a* (see FIG. 2). The guide projections 18, 20, 22, 24 are formed on the anti-kink bush 10 offset relative to one another in the peripheral direction. The guide projections 18, 20, 22, 24 are formed on the anti-kink bush 10 offset relative to one another about the axis M by 90°. The guide projections 18, 20, 22, 24 define between them the guideways 26, 32, 34 and 36. Each of the guide projections 18, 20, 22, 24 has a snap-in recess or a snap-in groove 30 which is open towards the end 28*a* of the anti-kink bush 10.

Figure 4:
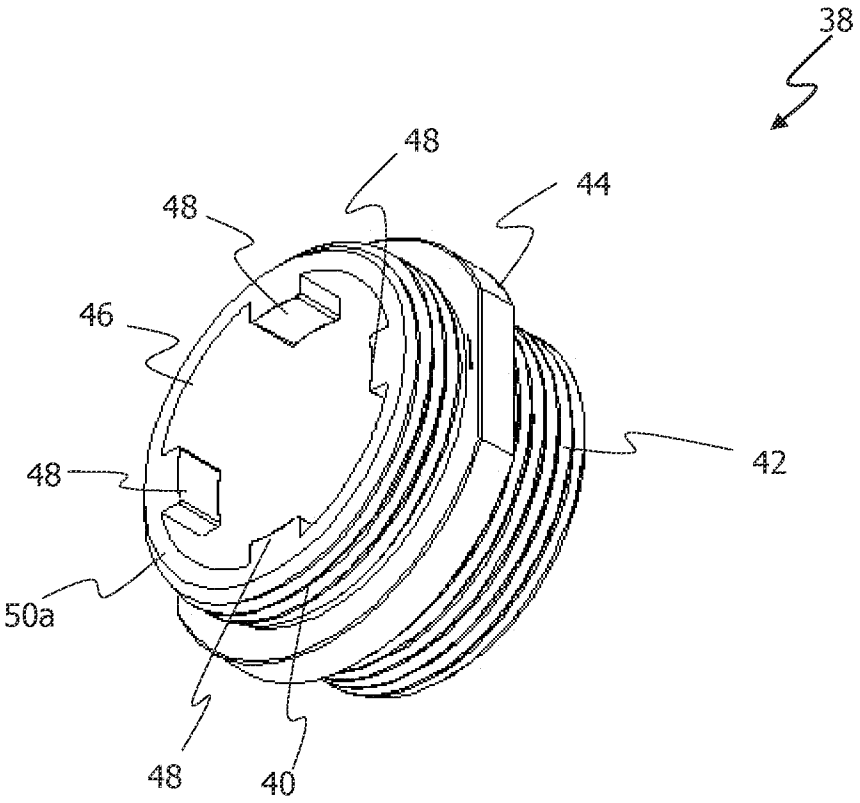
FIGS. 4 to 7 are views of a first connecting element.

FIG. 4 is a perspective view of a first connecting element 38. The connecting element 38 has two threaded portions 40 and 42 with an external thread, which portions are separated from one another by a bearing portion 44. An opening 46 extends through the first connecting element 38. Snap-in projections 48 extend radially inwards starting from the inner peripheral surface of the opening 46. The snap-in projections 48 have a predetermined axial extent, with which they extend starting from the end face 50*a* along the inner peripheral surface of the opening 46. The snap-in projections 48 are arranged offset relative to one another in the peripheral direction of the first connecting element 38.

Figure 5:
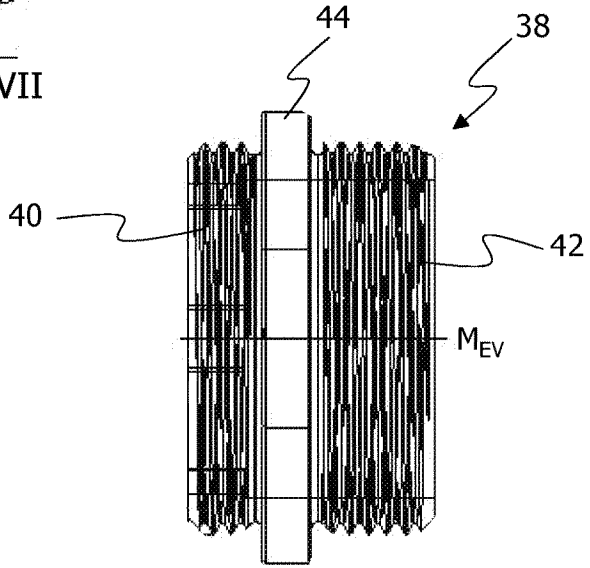

FIG. 5 is a side view of the connecting element 38, in which the two threaded portions 40 and 42 are shown. The threaded portions 40 and 42 are separated from one another by a bearing portion 44 which extends in the radial direction and protrudes radially beyond the threaded portions 40 and 42. The bearing portion 44 is arranged in the direction of the axis $M_{EV}$ between the threaded portions 40 and 42.

Figure 6:
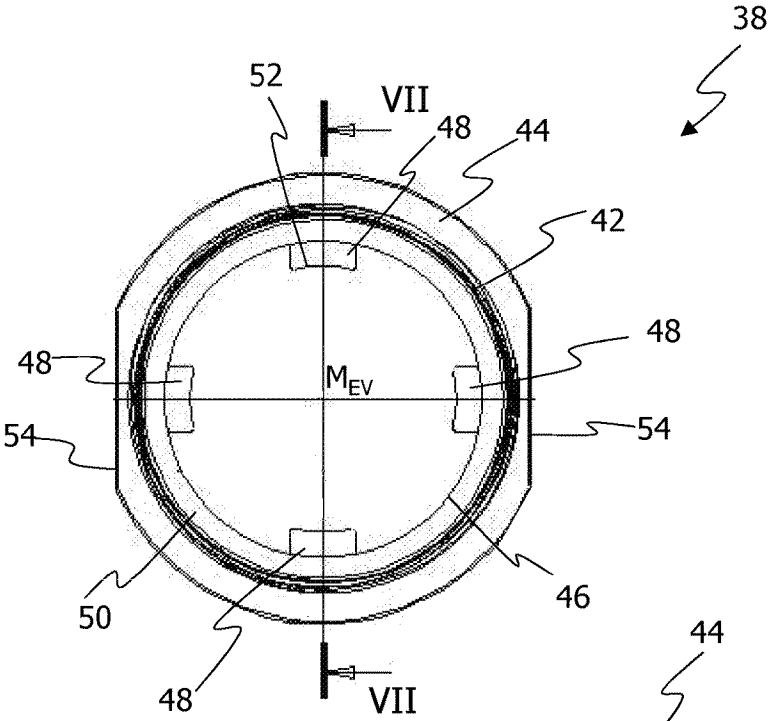

FIG. 6 is a top view of the first connecting element 38. The opening 46 extends through the connecting element 38. The snap-in projections 48 extend radially inwards starting from the inner peripheral surface of the opening 46. The snap-in projections 48 are formed in the opening 46 offset by 90° relative to one another. Two mutually opposite snap-in projections 48 in each case reduce an inside diameter of the opening 46 between them. Radially inner surfaces 52 of opposing snap-in projections 48 define between them the reduced inside diameter of the opening 46. The radially inner surface 52 of the snap-in projections is curved. The degree of curvature of the surface 52 can be matched to the radius of the anti-kink bush 10 in the region of the guideways 26, 32, 34, 36 (see FIGS. 1 to 3).

Flattened regions 54 are visible on the bearing portion 44, that is to say the bearing portion 44 is not circular. A tool can be located on the flattened portions 54. The flattened portions 54 form so-called flats, on which a spanner (not shown), for example, can be located. The tool or the spanner can be used, for example, to hold the first connecting element 38 stationary.

Figure 7:
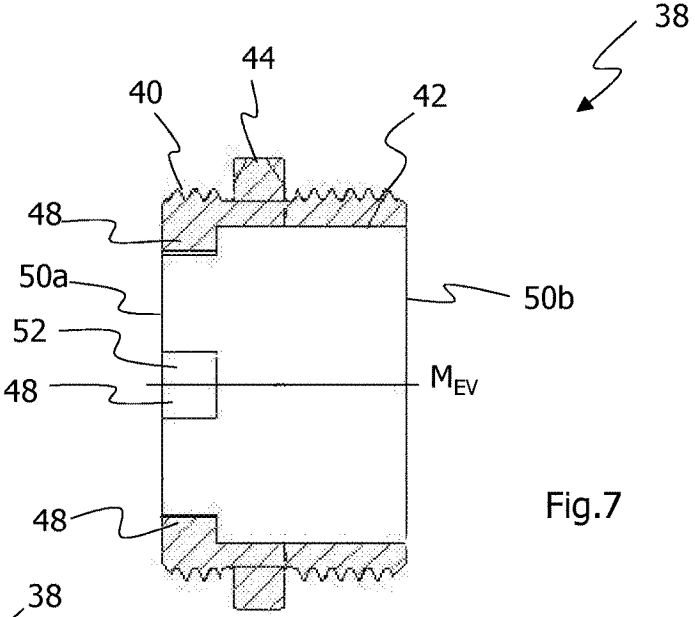

FIG. 7 is a sectional view along cutting line VII-VII in FIG. 6. The snap-in projections 48 are provided in the region of the threaded portion 40. Starting from the end face 50*a*, the snap-in projections 48 extend along the inner peripheral surface of the opening 46 in the direction of the axis $M_{EV}$, or in the direction of the end face 50*b*. The snap-in projections 48 extend between the end face 50*a* and the bearing portion 44, the snap-in projections 48 not extending as far as the bearing portion 44.

Figure 8:
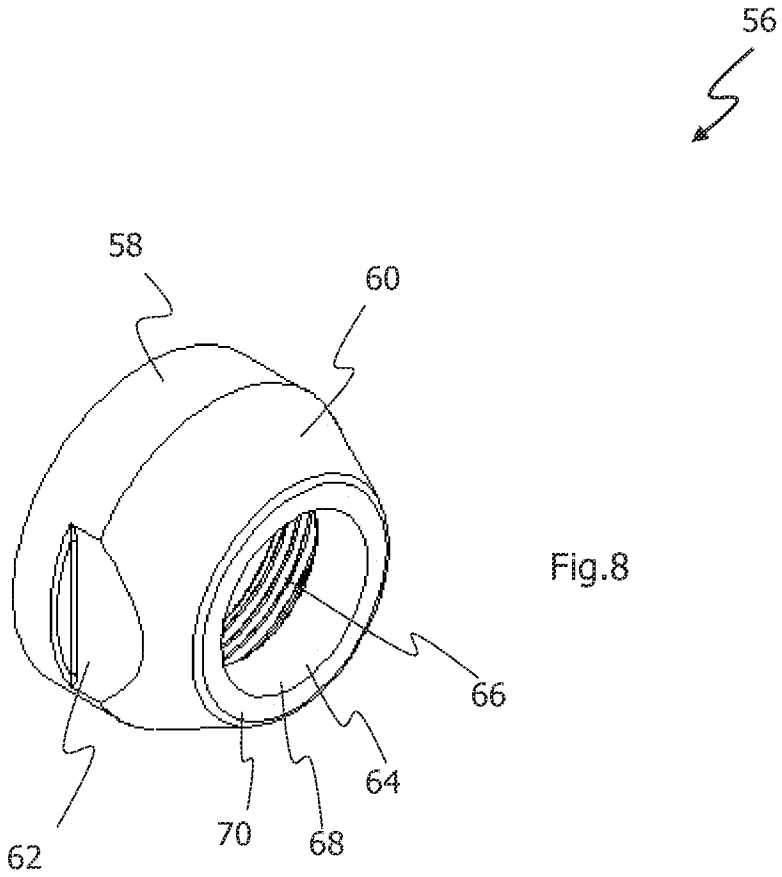
FIGS. 8 to 12 are views of a second connecting element.

FIG. 8 is a perspective view of a second connecting element 56. The second connecting element 56 is in the form of a cap nut. The second connecting element 56 has a substantially cylindrical portion 58 and a substantially conical portion 60. A flattened region 62 is further formed on the connecting element 56. An opening 64 extends through the second connecting element 56. The opening 64 has a threaded portion 66 and a cylindrical portion 68 which extends into the opening 66 starting from the end face 70.

Figure 10:
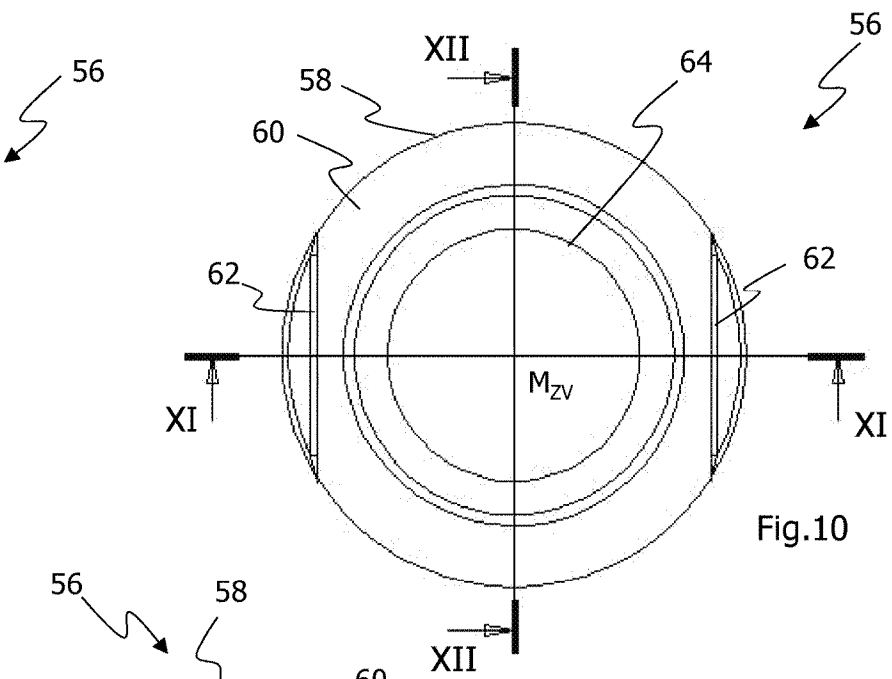
Figure 9:
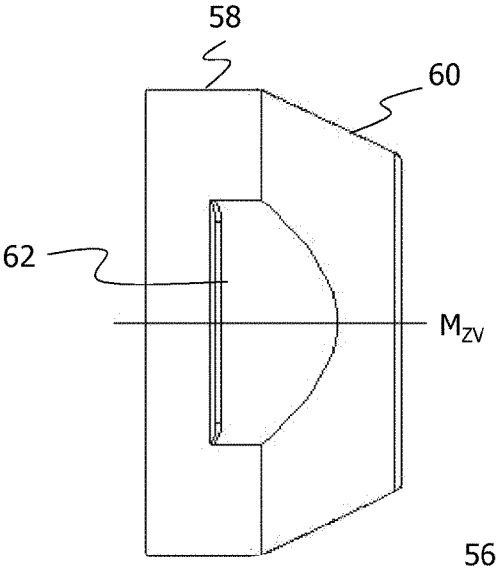

FIG. 9 is a side view and FIG. 10 is a top view of the second connecting element 56. The flattened region 62 extends in part along the cylindrical portion 58 and the conical portion 60. As can be seen in FIG. 10, two flattened regions 62 are provided. At the regions 62, which form so-called flats, a tool can be located on the second connecting element 56. A spanner, for example, can be used for that purpose. The tool can serve for screwing the second connecting element 56 to the first connecting element 38. During screwing, the first connecting element 38 can be held stationary at the flat portions 54 by a tool.

Figure 11:
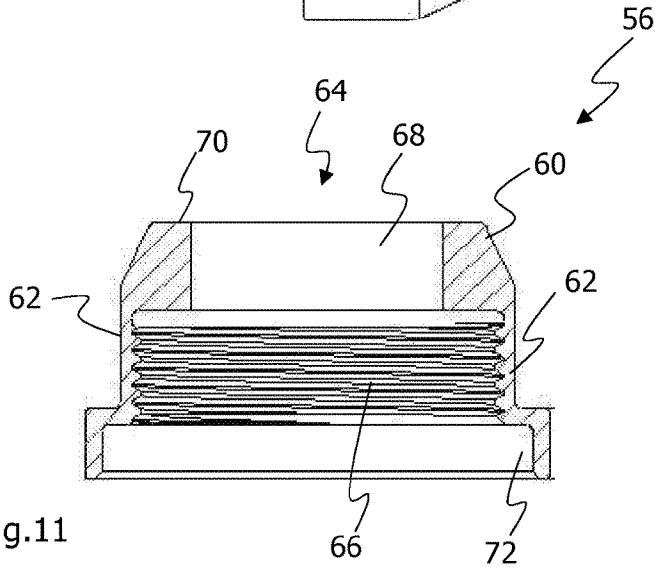
Figure 13:
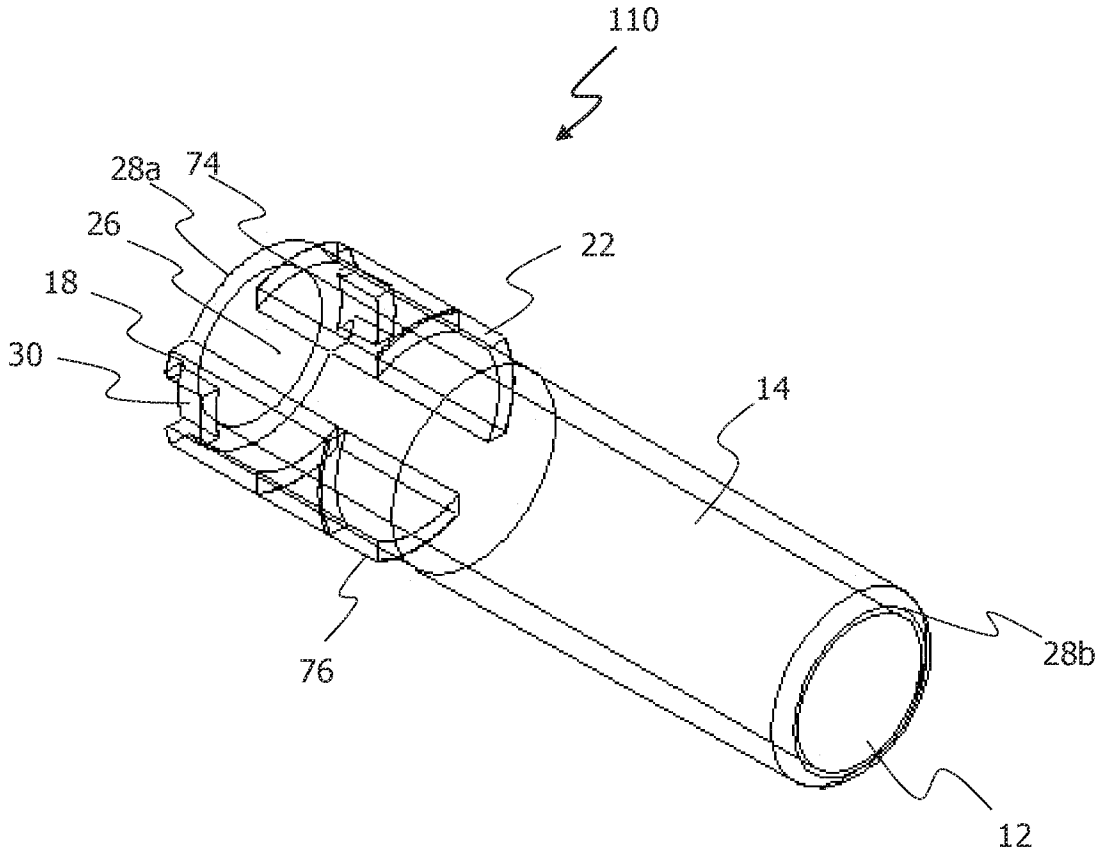

FIG. 11 is a sectional view along cutting line XI-XI in FIG. 10. The opening 64 extends through the second connecting element 56. The opening 64 is stepped. The opening 64 has substantially three portions which differ in their inside diameters. The portion 68 having the smallest inside diameter is substantially cylindrical and extends starting from the end face 70 to the threaded portion 66. The portion 68 is followed by the threaded portion 66, which has a larger inside diameter than the cylindrical portion 68. The threaded portion 66 is followed by a receiving portion 72, which in turn has a larger inside diameter than the threaded portion 66. The receiving portion 72 serves for receiving the bearing portion 44 of the first connecting element 38 (see FIGS. 4 to 7) when the threaded portion 66 of the second connecting element 56 is screwed to the threaded portion 42 of the first connecting element 38. The second connecting element 56 can be screwed to the first connecting element 38 by means of a tool (not shown) which is located at the flattened regions 62.

Figure 12:
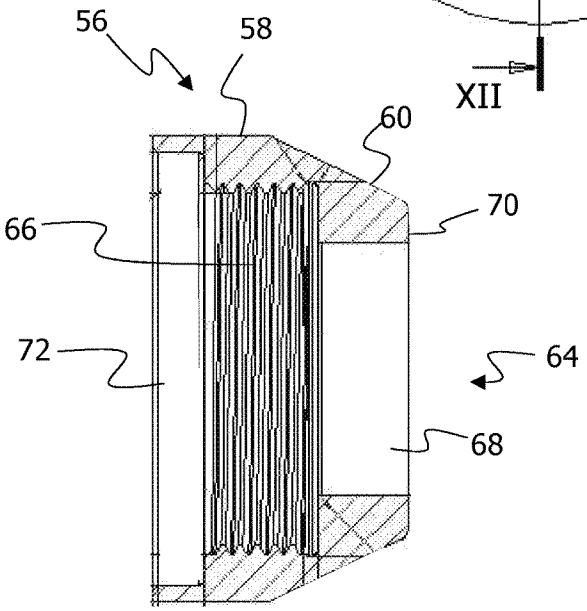

FIG. 12 is a sectional view along cutting line XII-XII in FIG. 10. The cylindrical portion 58 and the conical portion 60 of the second connecting element 56 are visible in FIG. 12. The opening 64 with its three portions 66, 68 and 72, each of which has a different inside diameter, extends in stepped manner through the second connecting element 56.

FIGS. 13 to 16 are views of an anti-kink bush 110 according to a second embodiment. The same reference numerals as in the first embodiment are used for features of the same type. The fundamental differences between the anti-kink bush according to the first embodiment, described with reference to FIGS. 1 to 4, and the anti-kink bush 110 lie in the guide projections. The anti-kink bush 110 has guide projections 18, 22, 74, 76. Unlike in the embodiment described with reference to FIGS. 1 to 4, only the guide projections 18 and 22 have snap-in recesses 30. The guide projections 74 and 76 serve solely as a guide projection. The guide projections 18, 22, 74, 76 define between them guideways 26, 32, 34, 36. The guide projections 18 and 22 extend along the anti-kink bush 110 starting from the end face 28*a* in the direction of the axis M. The projections 74 and 76 without a snap-in recess 30 are at a distance from the end face 28*a* in the direction of the axis M.

The function and cooperation of the components described in detail above, which form the anti-kink device for a cable, is described hereinbelow. The anti-kink device for a cable is formed by the anti-kink bush 10, the first connecting element 38 and the second connecting element 56. The snap-in projections 48 of the first connecting element 38 cooperate with the guideways 26, 32, 34 and 36 in order to allow the anti-kink bush 10 to be guided through the opening 46 in the first connecting element 38. To that end, the first connecting element 38 and the anti-kink bush 10 are so aligned that the snap-in projections 48 of the first connecting element 38 engage into the guideways 26, 32, 34 and 36 defined by the guide projections 18, 20, 22, 24 of the anti-kink bush 10 (first position). In this state, the anti-kink bush 10 can be guided relative to the first connecting element 38 through the opening 46 in the first connecting element 38. The interengaging snap-in projections 48 and guide projections 18, 20, 22, 24 center the anti-kink bush 10 on the first connecting element 38, so that a guided movement of the anti-kink bush 10 relative to the first connecting element 38 is possible.

For termination, the anti-kink bush, together with a cable, can thus be guided unhindered through the first connecting element 38 in the first position. Thereafter, the cable (not shown) can be terminated or connected to a connector. When termination is complete, the anti-kink bush 10 is withdrawn and again guided through the opening 46 in the first connecting element 38. The anti-kink bush 10 and the first connecting element 38 are thereby in the first position. As soon as the guideways 26, 32, 34 and 36 release the second snap-in elements 48 completely, the anti-kink bush 10 can be rotated relative to the first connecting element 38. For example, the anti-kink bush 10 can be rotated through 45° relative to the first connecting element 38. As a result of the rotation, the snap-in recesses 30 and the snap-in projections 48 are substantially in alignment (second position). In this (second) position, the snap-in projections 48 on the first connecting element 38 can be locked with the snap-in recesses 30 of the guide projections 18, 20, 22, 24.

The snap-in recesses 30 and the snap-in projections 48 can be locked by a movement in the axial direction. In the locked state, the anti-kink bush 10 and the first connecting element 38 can no longer be rotated relative to one another. Furthermore, a relative movement of the anti-kink bush 10 relative to the first connecting element 38 is blocked by the snap-in recesses 30 forming a stop for the snap-in projections 48. The snap-in projections 48 thus establish an interlocking connection with the snap-in recesses 30. The interlocking connection between the snap-in projections 48 and the snap-in recesses 30 acts in the peripheral direction and also in the axial direction of the anti-kink bush 10, or of the first connecting element 38. Because of the interlocking connection between the snap-in projections 48 and the snap-in recesses 30, the anti-kink bush 10 can no longer be rotated relative to the first connecting element 38. An anti-rotation device can also be provided by the interlocking connection. As a result of the screwing of the threaded portion 66 of the second connecting element 56 to the threaded portion 42 of the first connecting element 38 there is an interlocking connection between the anti-kink bush 10, the first connecting element 38 and the second connecting element 56.

Fitting of the anti-kink device is completed by connecting the second connecting element 56 to the first connecting element 38. The second connecting element 56 fixes the anti-kink bush 10 and the first connecting element 38 to one another in the second position. If the first connecting element 38 and the second connecting element 56 are screwed together, the receiving portion 72 of the second connecting element 56 receives the bearing portion 44 of the first connecting element 38.

Fitting of the anti-kink device takes place in the same manner if termination has already taken place or is not necessary. In this case, the termination step can be omitted.

The anti-kink device for a cable described by way of example hereinbefore has a simplified construction. The anti-kink device can be fitted and removed quickly and simply. Because it is easy to fit and remove, the anti-kink device can be cleaned quickly and simply. For this reason inter alia, the anti-kink device is also suitable for use in the medical field. The anti-kink device can thus be used together with medical devices.

The aspects and features which have been mentioned and described together with one or more of the examples and figures described in detail hereinbefore can further be combined with one or more of the other examples in order to replace a similar feature of the other example or in order to additionally incorporate the feature into the other example.

The description and drawings show only the principles of the disclosure. Furthermore, the examples given herein are expressly to serve only teaching purposes, in order to assist the reader in understanding the principles of the disclosure and the concepts contributed by the inventor(s) to the further development of the technology. All statements made herein regarding principles, aspects and examples of the disclosure, as well as particular exemplary embodiments thereof, are to include the equivalents thereof.

Furthermore, the following claims are hereby incorporated into the detailed description, where each claim can stand on its own as a separate example. When each claim can stand on its own as a separate example, it should be noted that—although a dependent claim in the claims may relate to a particular combination with one or more other claims—other exemplary embodiments may also include a combination of the dependent claim with the subject matter of any other dependent or independent claim. Such combinations are proposed here, unless it is stated that a particular combination is not intended. Furthermore, features of a claim are also to be included for any other independent claim, even if that claim is not made directly dependent on the independent claim.

The present disclosure is of course not limited to the embodiments described hereinbefore. On the contrary, many possibilities for modifications thereof will be apparent to an average person skilled in the art without departing from the underlying idea of the present disclosure as defined in the accompanying claims.

The invention claimed is:

1. An anti-kink device for a cable, having: an anti-kink bush which can be secured on a cable, wherein the anti-kink bush has at least one first snap-in element, wherein the anti-kink bush has guide projections which are offset relative to one another and form between them at least one guideway for the at least one second snap-in element of the first connecting element, a first connecting element which has an opening for the passage of the anti-kink bush, wherein the first connecting element has at least one second snap-in element, a second connecting element which can be connected to the first connecting element, said anti-kink bush and said first connecting element being relatively rotatable between at least a first predetermined position and a second predetermined position, wherein the first predetermined position and the second predetermined position differ from each other, wherein the at least one first snap-in element and the at least one second snap-in element are configured such that, in the first position of the anti-kink bush relative to the first connecting element, they allow the anti-kink bush to be guided through the opening of the first connecting element, wherein, in the first position, the at least one guideway is configured to cooperate with the at least one second snap-in element in order to guide the movement of the anti-kink bush through the opening in the first connecting element and, in the second position of the anti-kink bush relative to the first connecting element, they can be locked together, wherein in the second position, the at least one first snap-in element and the at least one second snap-in element are configured to block a movement of the anti-kink bush through the opening of the first connecting element, and wherein the at least one first snap-in element and the at least one second snap-in element are configured such that, in the second position, they establish an interlocking connection acting in the peripheral direction of the anti-kink bush and/or of the first connecting element, wherein the second connecting element is configured to fix the anti-kink bush and the first connecting element to one another in the second position.

2. The anti-kink device as claimed in claim 1, wherein the at least one first snap-in element and the at least one second snap-in element can be transferred out of the first position into the second position and back by a relative movement between the anti-kink bush and the first connecting element.

3. The anti-kink device according to claim 1, wherein at least one of the guide projections of the anti-kink bush has at least one first snap-in element.

4. The anti-kink device as claimed in claim 1, wherein the guide projections are formed integrally with the anti-kink bush.

5. The anti-kink device as claimed in claim 1, wherein the at least one second snap-in element is a snap-in projection which protrudes radially inwards.

6. The anti-kink device as claimed in claim 1, wherein the at least one first snap-in element is a snap-in recess.

7. A method of fitting an anti-kink device for a cable as claimed in claim 1, comprising the steps of:

rotating the anti-kink bush and/or the first connecting element into the first position, in which the at least one first snap-in element and the at least one second snap-in element allow the anti-kink bush to move through the opening of the first connecting element;

moving the anti-kink bush and the cable connected thereto through the first connecting element, wherein the anti-kink bush and the first connecting element are in the first position, wherein, in the first position, the at least one guideway cooperates with the at least one second snap-in element in order to guide the movement of the anti-kink bush through the opening in the first connecting element;

withdrawing the anti-kink bush and the cable in the first position through the opening in the first connecting element, wherein the anti-kink bush and the first connecting element are in the first position;

rotating the anti-kink bush and/or the first connecting element into the second position, in which the at least one first snap-in element and the at least one second snap-in element can be locked together, wherein in the second position, the at least one first snap-in element and the at least one second snap-in element are configured to block a movement of the anti-kink bush through the opening of the first connecting element;

locking the at least one first snap-in element and the at least one second snap-in element together, wherein the at least one first snap-in element and the at least one second snap-in element, in the second position, establish an interlocking connection acting in the peripheral direction of the anti-kink bush and/or of the first connecting element; and connecting the first connecting element and the second connecting element, wherein the second connecting element fixes the anti-kink bush and the first connecting element to one another in the second position.

* * * * *